US007549297B2

(12) United States Patent
Martin et al.

(10) Patent No.: US 7,549,297 B2
(45) Date of Patent: Jun. 23, 2009

(54) REFRIGERATOR AIR CONTROL DAMPER FOR ICE COMPARTMENT

(75) Inventors: Dean A. Martin, Solon, IA (US); Alvin V. Miller, Swisher, IA (US); Scott Timothy Tunzi, Middleton, WI (US); Kyle B. Van Meter, Coralville, IA (US)

(73) Assignee: Maytag Corporation, Benton Harbor, MI (US)

( * ) Notice: Subject to any disclaimer, the term of this patent is extended or adjusted under 35 U.S.C. 154(b) by 597 days.

(21) Appl. No.: 11/331,885

(22) Filed: Jan. 13, 2006

(65) Prior Publication Data

US 2006/0260344 A1 Nov. 23, 2006

Related U.S. Application Data

(63) Continuation-in-part of application No. 11/139,237, filed on May 27, 2005, now Pat. No. 7,337,620, which is a continuation-in-part of application No. 11/131,701, filed on May 18, 2005, now Pat. No. 7,284,390.

(51) Int. Cl.
*F25C 1/12* (2006.01)

(52) U.S. Cl. ..... 62/66; 62/187; 62/344

(58) Field of Classification Search ..... 62/66–74, 62/187, 340–356
See application file for complete search history.

(56) References Cited

U.S. PATENT DOCUMENTS

| | | | |
|---|---|---|---|
| 2,139,441 | A | 12/1938 | Clarke |
| 2,223,947 | A | 12/1940 | Blood et al. |
| 2,256,551 | A | 9/1941 | Colvin |
| 2,400,634 | A | 5/1946 | Earle |

(Continued)

FOREIGN PATENT DOCUMENTS

| | | | |
|---|---|---|---|
| EP | 657706 | A1 | 6/1995 |

(Continued)

OTHER PUBLICATIONS

Adamski, Joseph R., U.S. Appl. No. 11/236,126, filed Sep. 27, 2005, Apparatus and Method for Dispensing Ice From a Bottom Mount Refrigerator.

(Continued)

*Primary Examiner*—William E Tapolcai
(74) *Attorney, Agent, or Firm*—Kirk Goodwin; Michael D. LaFrenz

(57) ABSTRACT

An insulated icemaking compartment is provided in the fresh food compartment of a bottom mount refrigerator. The icemaking compartment may be integrally formed with the liner of the fresh food compartment, or alternatively, may be modular for installation anywhere in the fresh food compartment. A removable bin assembly with a front cover normally seals the icemaking compartment to maintain the temperature in the compartment. A cold air duct formed in the rear wall of the refrigerator supplies cold air from the freezer compartment to the icemaking compartment. A return air duct directs a portion of the air from the icemaking compartment back to the freezer compartment. An air vent with a damper in the icemaking compartment directs another portion of air into the fresh food compartment. A control system provides for controlling refrigerator functions in a manner that promotes energy efficiency, including movement of the damper between open and closed positions.

19 Claims, 13 Drawing Sheets

U.S. PATENT DOCUMENTS

| | | | | |
|---|---|---|---|---|
| 2,410,334 | A | | 10/1946 | Brace |
| 2,493,488 | A | | 1/1950 | Jordan et al. |
| 2,544,394 | A | | 3/1951 | Muffly |
| 2,605,621 | A | | 8/1952 | Kellershon |
| 2,717,505 | A | | 9/1955 | Andersson |
| 2,765,633 | A | | 10/1956 | Muffly |
| 2,774,224 | A | | 12/1956 | Bayston |
| 2,779,165 | A | | 1/1957 | Pichler |
| 2,795,117 | A | | 6/1957 | Herndon Jr, et al. |
| 2,907,180 | A | * | 10/1959 | Mann ..... 62/155 |
| 3,046,754 | A | | 7/1962 | Kniffin |
| 3,100,970 | A | | 8/1963 | Elfving |
| 3,126,714 | A | | 3/1964 | Zuercher, Jr. |
| 3,146,601 | A | | 9/1964 | Gould |
| 3,146,606 | A | | 9/1964 | Grimes et al. |
| 3,182,464 | A | | 5/1965 | Archer |
| 3,192,726 | A | | 7/1965 | Newton |
| 3,225,559 | A | | 12/1965 | Fischer |
| 3,226,939 | A | | 1/1966 | Harbison |
| 3,270,519 | A | | 9/1966 | Pohl, Jr. |
| 3,308,631 | A | | 3/1967 | Kniffin |
| 3,382,682 | A | | 5/1968 | Frohbieter |
| 3,440,308 | A | | 4/1969 | Carbary et al. |
| 3,541,806 | A | | 11/1970 | Jacobs |
| 3,581,516 | A | | 6/1971 | Buchser |
| 3,602,007 | A | | 8/1971 | Drieci |
| 3,633,374 | A | | 1/1972 | Canter |
| 3,654,772 | A | | 4/1972 | Curry, III |
| 3,745,779 | A | | 7/1973 | Bright |
| 3,747,363 | A | | 7/1973 | Grimm |
| 3,775,994 | A | | 12/1973 | Linstromberg |
| 3,788,089 | A | | 1/1974 | Graves |
| 3,789,620 | A | | 2/1974 | Benasutti |
| 3,821,881 | A | | 7/1974 | Harkias |
| 3,834,177 | A | | 9/1974 | Scarlett |
| 3,850,008 | A | | 11/1974 | Frazier |
| 3,866,434 | A | | 2/1975 | Pugh |
| 3,889,888 | A | | 6/1975 | Prada |
| 4,003,214 | A | | 1/1977 | Schumacher |
| 4,007,600 | A | | 2/1977 | Simms |
| 4,020,644 | A | | 5/1977 | True, Jr. |
| 4,100,761 | A | | 7/1978 | Linstromberg |
| 4,118,451 | A | | 10/1978 | Schaus |
| 4,142,373 | A | | 3/1979 | Weibel |
| 4,142,377 | A | | 3/1979 | Fogt |
| 4,142,378 | A | | 3/1979 | Bright |
| 4,227,383 | A | | 10/1980 | Horvay |
| 4,250,923 | A | | 2/1981 | Johnson |
| 4,280,682 | A | | 7/1981 | Zukausky |
| 4,285,212 | A | | 8/1981 | Prada |
| 4,306,757 | A | | 12/1981 | Horvay |
| 4,332,146 | A | | 6/1982 | Yamazaki |
| 4,487,024 | A | | 12/1984 | Fletcher et al. |
| 4,587,810 | A | | 5/1986 | Fletcher |
| 4,614,088 | A | | 9/1986 | Brooks |
| 4,644,753 | A | | 2/1987 | Burke |
| 4,653,283 | A | * | 3/1987 | Sepso ..... 62/89 |
| 4,727,720 | A | | 3/1988 | Wernicki |
| 4,754,615 | A | | 7/1988 | Linstromberg |
| 4,756,165 | A | | 7/1988 | Chestnut et al. |
| 4,799,362 | A | | 1/1989 | Chestnut |
| 4,831,840 | A | | 5/1989 | Fletcher |
| 4,872,317 | A | | 10/1989 | Reed |
| 4,889,316 | A | | 12/1989 | Donahue, Jr. |
| 4,916,921 | A | | 4/1990 | Fletcher |
| 4,922,725 | A | | 5/1990 | Rasmussen |
| 4,924,680 | A | * | 5/1990 | Janke et al. ..... 62/187 |
| 4,961,320 | A | | 10/1990 | Gutmann |
| 5,010,738 | A | | 4/1991 | Brown |
| 5,014,520 | A | * | 5/1991 | Orner et al. ..... 62/187 |
| 5,033,636 | A | | 7/1991 | Jenkins |
| 5,090,208 | A | | 2/1992 | Aono et al. |
| 5,144,813 | A | * | 9/1992 | Orner et al. ..... 62/187 |
| RE34,174 | E | | 2/1993 | Brown et al. |
| 5,198,244 | A | | 3/1993 | Rice |
| 5,211,462 | A | | 5/1993 | Bien |
| 5,219,225 | A | | 6/1993 | Ball |
| 5,261,248 | A | | 11/1993 | Willis |
| 5,272,888 | A | | 12/1993 | Fisher |
| 5,273,219 | A | | 12/1993 | Beach |
| 5,310,090 | A | | 5/1994 | Taylor |
| 5,327,856 | A | | 7/1994 | Schroeder |
| 5,357,769 | A | | 10/1994 | Crabtree et al. |
| 5,361,596 | A | * | 11/1994 | Martin ..... 62/187 |
| 5,375,432 | A | | 12/1994 | Cur |
| 5,596,182 | A | | 1/1997 | Edwards |
| 5,642,628 | A | | 7/1997 | Whipple, III et al. |
| 5,711,159 | A | | 1/1998 | Whipple, III |
| 5,758,512 | A | | 6/1998 | Peterson et al. |
| 5,787,723 | A | | 8/1998 | Mueller et al. |
| 5,810,331 | A | | 9/1998 | Smock |
| 5,823,001 | A | | 10/1998 | Patrick |
| 5,829,263 | A | | 11/1998 | Park |
| 5,834,126 | A | | 11/1998 | Sheu |
| 5,846,446 | A | | 12/1998 | Jackson |
| 5,849,227 | A | | 12/1998 | Chikugo et al. |
| 5,899,083 | A | | 5/1999 | Peterson et al. |
| 6,019,447 | A | | 2/2000 | Jackovin |
| 6,050,097 | A | | 4/2000 | Nelson |
| 6,053,472 | A | | 4/2000 | DeLand |
| 6,055,826 | A | | 5/2000 | Hiraoka et al. |
| 6,062,826 | A | | 5/2000 | Morimoto |
| 6,082,130 | A | | 7/2000 | Pastryk |
| 6,090,281 | A | | 7/2000 | Buckner |
| 6,091,062 | A | | 7/2000 | Pfahnl et al. |
| 6,148,624 | A | | 11/2000 | Bishop |
| 6,286,324 | B1 | | 9/2001 | Pastryk |
| 6,312,608 | B1 | | 11/2001 | Buckner |
| 6,314,745 | B1 | | 11/2001 | Janke |
| 6,351,955 | B1 | | 3/2002 | Oltman et al. |
| 6,351,958 | B1 | | 3/2002 | Pastryk |
| 6,351,967 | B1 | | 3/2002 | Adachi |
| 6,401,461 | B1 | | 6/2002 | Harrison et al. |
| 6,412,286 | B1 | | 7/2002 | Park et al. |
| 6,422,031 | B1 | | 7/2002 | Mandel et al. |
| 6,425,425 | B2 | | 7/2002 | Bianchi et al. |
| 6,438,988 | B1 | | 8/2002 | Paskey |
| 6,464,854 | B2 | | 10/2002 | Andrews et al. |
| 6,474,094 | B2 | | 11/2002 | Kim |
| 6,604,377 | B2 | | 8/2003 | Watanabe |
| 6,612,116 | B2 | | 9/2003 | Fu et al. |
| 6,694,754 | B1 | | 2/2004 | Schenk |
| 6,708,726 | B2 | | 3/2004 | Hashimoto |
| 6,725,680 | B1 | | 4/2004 | Schenk |
| 6,732,537 | B1 | | 5/2004 | Anell et al. |
| 6,735,959 | B1 | | 5/2004 | Najewicz |
| 6,755,166 | B2 | | 6/2004 | Chang |
| 6,820,433 | B2 | | 11/2004 | Hwang |
| 6,845,631 | B1 | | 1/2005 | Hallin et al. |
| 6,880,355 | B2 | | 4/2005 | Jung |
| 6,964,177 | B2 | | 11/2005 | Lee et al. |
| 7,065,975 | B1 | | 6/2006 | Herndon et al. |
| 7,076,967 | B2 | | 7/2006 | Lee et al. |
| 2002/0121096 | A1 | | 9/2002 | Harrison et al. |
| 2002/0124576 | A1 | | 9/2002 | Loibl et al. |
| 2003/0010056 | A1 | | 1/2003 | Sakamoto et al. |
| 2003/0046947 | A1 | | 3/2003 | Ohya et al. |
| 2004/0148957 | A1 | | 8/2004 | Pohl et al. |
| 2004/0237565 | A1 | | 12/2004 | Lee et al. |
| 2005/0050907 | A1 | * | 3/2005 | Unger et al. ..... 62/187 |
| 2005/0061016 | A1 | | 3/2005 | Lee et al. |

2006/0090496 A1 5/2006 Adamski et al.

FOREIGN PATENT DOCUMENTS

| | | | |
|---|---|---|---|
| EP | 1 445 558 | | 11/2003 |
| EP | 1 482 263 | A2 | 1/2004 |
| EP | 482 263 | | 1/2004 |
| EP | 1 517 103 | A2 | 3/2005 |
| EP | 1 519 131 | A1 | 3/2005 |
| GB | 2 167 544 | | 10/1985 |
| GB | 2 242 731 | A | 10/1991 |
| JP | 500 69644 | | 6/1975 |
| JP | 0356113417 | A | 9/1981 |
| JP | 2002228316 | | 8/2002 |
| WO | WO 03/102481 | A1 | 12/2003 |
| WO | WO 2004/085937 | A1 | 10/2004 |

OTHER PUBLICATIONS

Anderson, Ronald K., U.S. Appl. No. 11/140,100, filed May 27, 2005, Refrigerator With Improved Icemaker.

Brain, Marshall "How Refrigerators Work" http://home.howstuffworks.com/refrigerator.htm/printable 6 pages, Feb. 4, 2005.

Coulter, Tim, U.S. Appl. No. 11/139,237, filed May 27, 2005, Insulated Ice Compartment for Bottom Mount Refrigerator.

* cited by examiner

REFRIGERATOR AIR CONTROL DAMPER FOR ICE COMPARTMENT

CROSS-REFERENCE TO RELATED APPLICATIONS

This application is a continuation-in-part application of U.S. application Ser. No. 11/139,237, filed May 27, 2005, entitled INSULATED ICE COMPARTMENT FOR BOTTOM MOUNT REFRIGERATOR, which is a continuation-in-part of and U.S. application Ser. No. 11/131,701, filed May 18, 2005, entitled REFRIGERATOR WITH INTERMEDIATE TEMPERATURE ICEMAKING COMPARTMENT, both of which are herein incorporated by reference in their entirety.

BACKGROUND OF THE INVENTION

Household refrigerators generally come in three structural styles: (1) a side-by-side model wherein the freezer and refrigerator compartments are side by side; (2) a top mount model wherein the freezer compartment is located above the refrigerator compartment; and (3) a bottom mount model wherein the freezer compartment is mounted below the refrigerator compartment. An icemaker is normally provided in the freezer compartment of all three models. A door mounted ice dispenser is often provided in a side-by-side refrigerator and in a top mount refrigerator so that a person can add ice to a glass without opening the freezer or refrigerator door. However, a door mounted ice dispenser normally is not been provided in bottom mount refrigerators, since the freezer door is too low, and there are difficulties in transporting ice from the freezer compartment to the refrigerator compartment which precludes a dispenser in the refrigerator compartment door. However, it is desirable to have an ice dispenser in the refrigerator compartment of a bottom mount refrigerator.

Providing an icemaking compartment within the fresh food compartment of a refrigerator presents numerous issues, both structural and functional. For example, the fresh food compartment is normally about 40° F., while an ice compartment needs to be less than 32° F. in order to make ice effectively and efficiently and is typically at, or about 0° F. Maintaining and controlling the temperature within the icemaking compartment requires insulation, seals, appropriate airflow, and a control system. Placing the icemaking compartment within the fresh food compartment of the refrigerator also requires consideration of electrical connections of the icemaker and the supply of water to the icemaker. The method of manufacturing of such an icemaking compartment within the fresh food compartment of a refrigerator also raises novel and unique considerations which are not factors for an icemaking compartment mounted in a freezer.

U.S. Pat. No. 6,735,959 issued to Najewicz discloses a thermoelectric icemaker placed within the fresh food compartment of a bottom mount refrigerator that may be dispensed through the fresh food door. Najewicz forms ice within the fresh food compartment using the thermoelectric icemaker even though the compartment is above a freezing temperature. Although Najewicz provides for a duct that runs from the freezer compartment to the thermoelectric icemaker, the cold air from the duct is used to remove heat from the thermoelectric icemaker. Najewicz has many problems that must be overcome in order to be practical including the removal of unfrozen water, rapid ice body formation, prolonged ice storage, etc. The present invention overcomes these problems.

SUMMARY OF THE INVENTION

Therefore it is a primary object, feature, or advantage of the present invention to improve over the state of the art.

A further object, feature, or advantage of the present invention is the provision of an improved refrigerator having an icemaking compartment within the fresh food compartment.

Another object, feature, or advantage of the present invention is the provision of a refrigerator having a separate icemaking compartment maintained at a temperature between 0° and 32° F.

A further object, feature, or advantage of the present invention is the provision of a refrigerator having an insulated icemaking compartment remote from the freezer compartment.

Still another object, feature, or advantage of the present invention is the provision of a bottom mount refrigerator having an icemaking compartment integrally formed in the liner of the fresh food compartment.

Yet another object, feature, or advantage of the present invention is the provision of a bottom mount refrigerator having a modular icemaking compartment mounted in the fresh food compartment.

A further object, feature, or advantage of the present invention is the provision of a bottom mount refrigerator having an icemaking compartment in the fresh food compartment, and having an insulated and sealed front cover on the icemaking compartment which can be opened to provide access into the compartment.

Another object, feature, or advantage of the present invention is the provision of an icemaker in the refrigerator compartment of a bottom mount refrigerator, with a cold air duct to provide air from the freezer compartment to the icemaker.

Still another object, feature, or advantage of the present invention is the provision of an icemaker in the refrigerator compartment of a bottom mount refrigerator having efficient and timely icemaking capacity.

It is a still further object, feature, or advantage of the present invention to provide a refrigerator that is energy efficient.

Another object, feature, or advantage of the present invention is to provide a refrigerator that enhances safety.

Yet another object, feature, or advantage of the present invention is to provide a refrigerator that provides convenience to users.

A further object, feature, or advantage of the present invention is to provide a refrigerator that is aesthetically pleasing to users.

A still further object, feature, or advantage of the present invention is to provide a refrigerator with a control system design that minimizes the complexity and the number of components necessary.

Another object, feature, or advantage of the present invention is to provide a refrigerator with a drive for the ice box/fresh food compartment damper which provides feedback.

A still further object, feature, or advantage of the present invention is to provide a refrigerator with a menu-driven interface.

Another object, feature, or advantage of the present invention is to provide a refrigerator with a variable speed fan.

One or more of these and/or other objects, features, or advantages of the present invention will become from the specification and claims that follow.

The bottom mount refrigerator of the present invention has an icemaker within an insulated icemaking compartment in the fresh food or refrigerator compartment. Cold air is supplied to the icemaking compartment from the freezer compartment via a cold air duct. A return air duct extends from the icemaking compartment to the freezer compartment. The icemaking compartment also includes a vent opening for venting air to the refrigerator compartment. A fan draws or forces air through the duct from the freezer compartment to the icemaking compartment. The temperature in the ice making compartment is between 0° F. to 32° F., which is colder than the temperature of the refrigerator compartment, but not as cold as the freezer compartment. The icemaking compartment is preferably located in an upper corner of the refrigerator compartment. The door of the refrigerator compartment includes an ice dispenser to supply ice to a person without opening the refrigerator compartment door. The door may include an ice bin for storing ice from the icemaker.

A control system is provided for the refrigerator for controlling the making and dispensing of ice in the icemaking compartment within the fresh food compartment of the bottom mount refrigerator.

DETAILED DESCRIPTION OF THE PREFERRED EMBODIMENT

Figure 1:
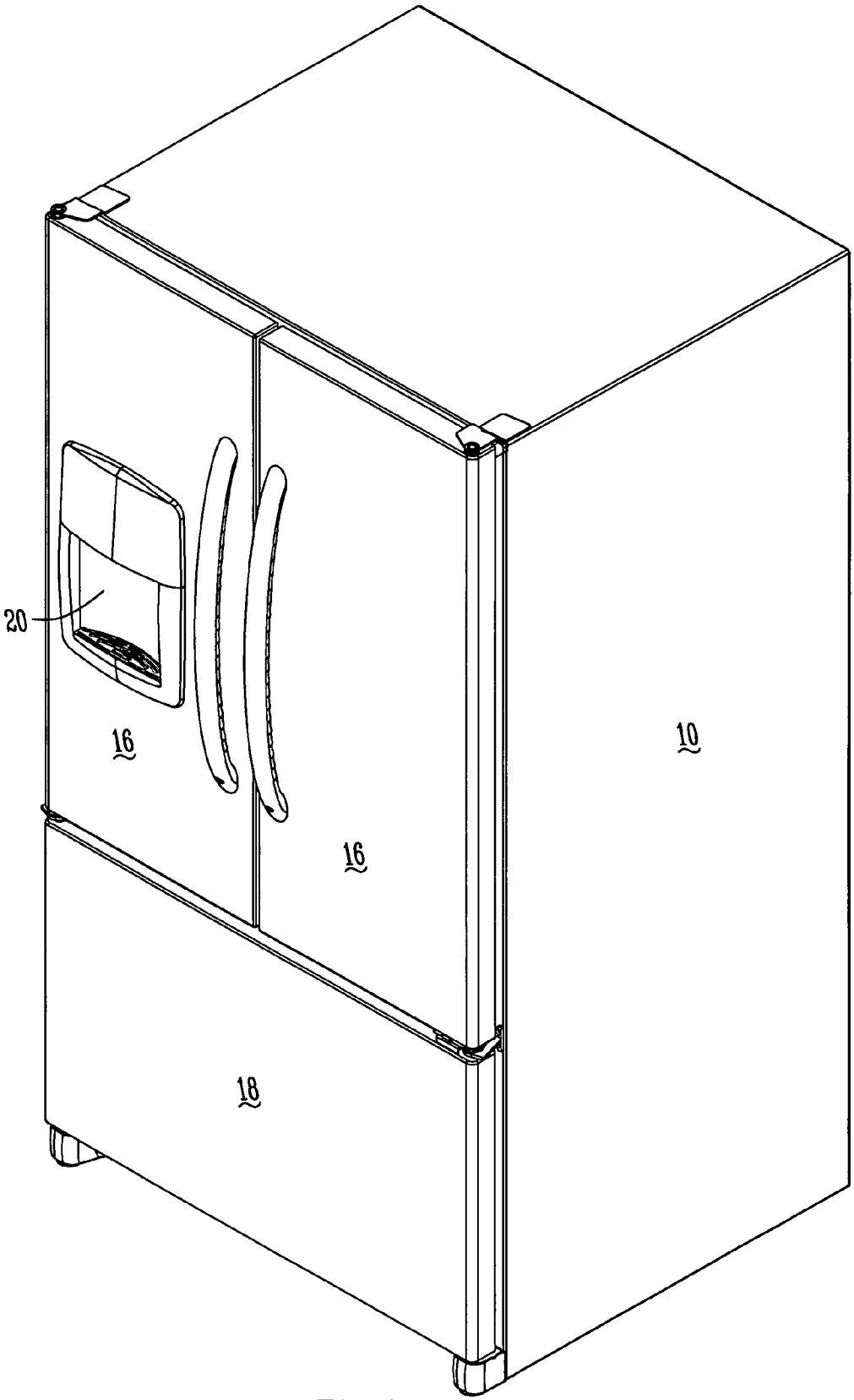
FIG. 1 is a perspective view of a bottom mount refrigerator according to the present invention.
Figure 2:
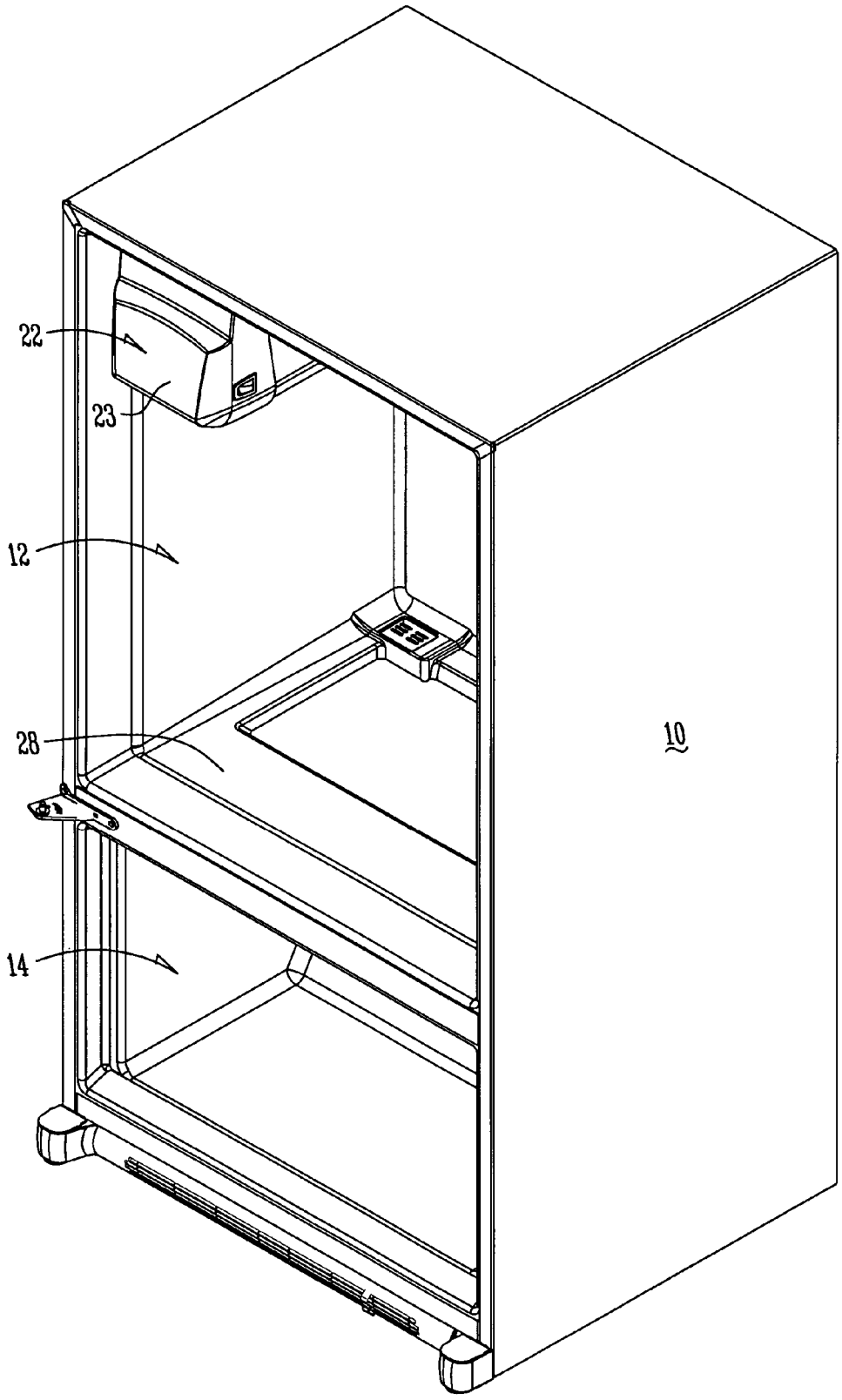
FIG. 2 is a perspective view of the bottom mount refrigerator having the doors removed.

A bottom mount refrigerator is generally designated in the drawings by the reference numeral 10. The refrigerator 10 includes a refrigerator or fresh food compartment 12 and a freezer compartment 14. Doors 16 are provided for the refrigerator compartment or fresh food compartment 12 and a door 18 is provided for the freezer compartment 14. One of the doors 16 includes an ice dispenser 20, which may also include a water dispenser.

Intermediate Temperature Icemaking Compartment

An icemaking compartment or intermediate compartment 22 is provided in the refrigerator compartment 12. The icemaking compartment 22 is shown to be in one of the upper corners of the refrigerator, or fresh food, compartment 12, but other locations are also within the scope of this invention. The icemaking compartment 22 has a front cover 23 that is insulated to prevent the cold air of the icemaking compartment 22 from passing into the refrigerator compartment and opening 21 is provided that mates with chute 19 of the ice dispenser 20. A seal may be provided between the opening 21 and chute 19 to prevent cold air from passing from the icemaking compartment to the refrigerator compartment 12. Chute 19 may be adapted to engage opening 21 upon closing of door 16. Chute 19 and opening 21 may be opposingly angled as to provide added sealing upon closing of door 16. Additionally, an intermediate piece may be used to improve the seal be between chute 19 and opening 21. For example, a resilient seal may be used to assist in achieving this seal. Alternatively, a spring or other elastic material or apparatus may be utilized between or about the junction of chute 19 and opening 21. Other alternatives for sealing between chute 19 and opening 21 should be evident to one skilled in the art.

Additionally, chute 19 should have a blocking mechanism located within or about it to assist in preventing or decreasing the flow of air or heat transfer within chute 19. For example, a flipper door that operates by a solenoid may be placed at the opening 21 to prevent cold air from leaving the icemaking compartment 22 and entering into the refrigerator compartment.

Preferably, the icemaking compartment 22 includes an icemaker 50 (as described below) that forms ice in an environment that is below freezing.

The icemaking compartment 22 may be integrally formed adjacent the refrigerator compartment 12 during the liner forming process and insulation filling process. In such a process the intermediate compartment may be separated on at least one side from the fresh food compartment by the refrigerator liner. Alternatively, the icemaking compartment 22 may be made or assembled remotely from the fresh food compartment and installed in the fresh food compartment 12. For example, this compartment 22 may be slid into the refrigerator compartment 12 on overhead rails (not shown) or other mounting. These methods are discussed subsequently.

The refrigerator 10 includes an evaporator 24 which cools the refrigerator compartment 12 and the freezer compartment 14. Normally, the refrigerator compartment 12 will be maintained at about 40° F. and the freezer compartment 14 will be maintained at approximately 0° F. The icemaking compartment is maintained at a temperature below 32° F. or less in order to form ice, but is preferably not as cold as the freezer compartment 14. Preferably this temperature is in the range of 20° F. The walls of the icemaking compartment are insulated to facilitate temperature control among other aspects. Grates or air vents 26 are provided in the wall 28 between the refrigerator compartment 12 and the freezer compartment 14 to allow air circulation between the compartments.

Air Ducts

Figure 5:
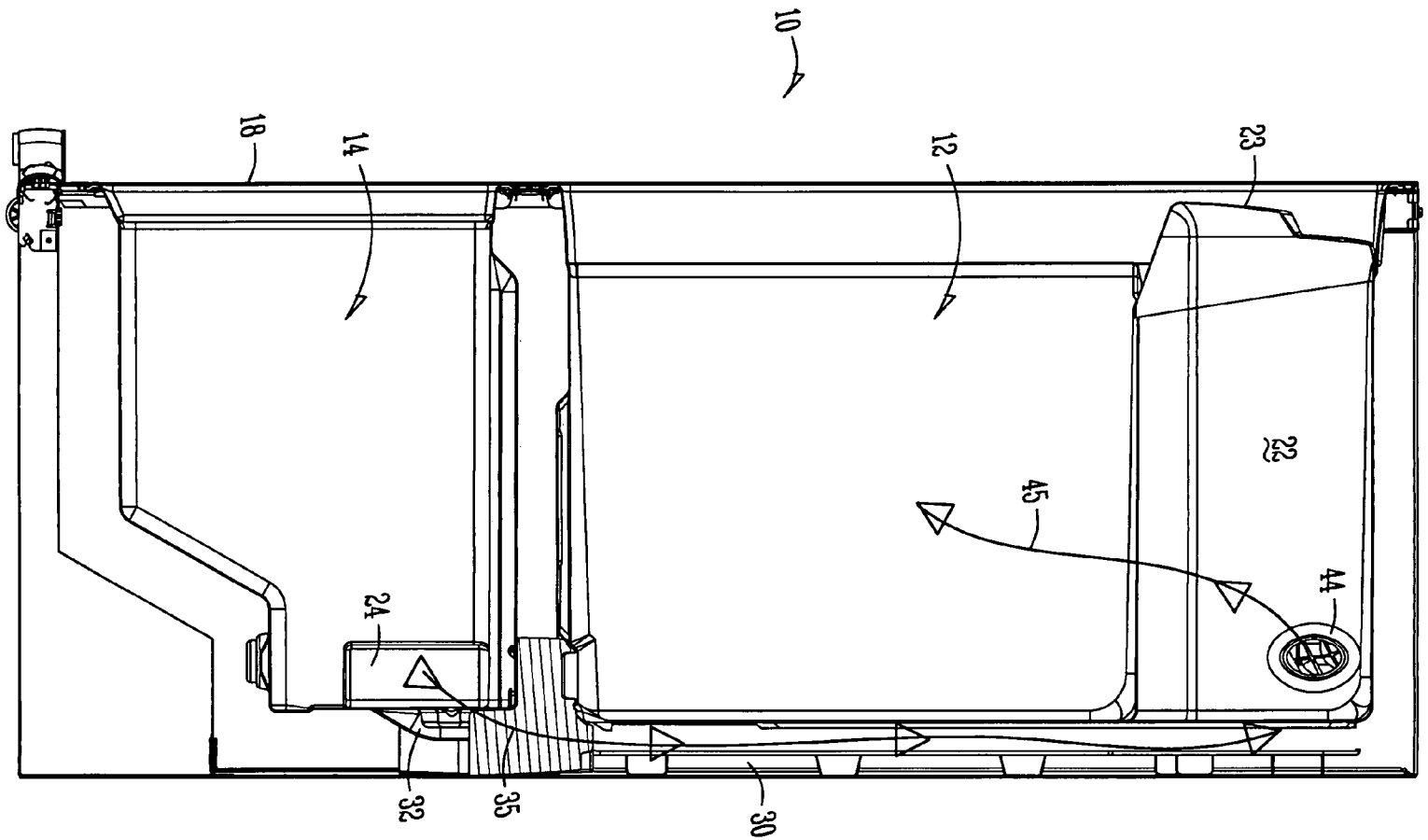
FIG. 5 is a sectional view taken along lines 5-5 of FIG. 4.

A cold air duct 30 extends between the freezer compartment 14 and the icemaking or specialty compartment 22. More particularly, the cold air duct 30 has a lower air inlet 32 within the freezer compartment 14 and an upper outlet end 34 connected to a fan 36 mounted on the back wall of the icemaker 22. The fan 36 draws cold air from the freezer compartment and forces the cold air into the icemaker 22 so as to facilitate icemaking. It is understood that the fan 36 may be located at the inlet end 32 of the cold air duct 30. The fan 36 controls the air flow from the freezer compartment 14 to the icemaking compartment 22 and may be a variable speed fan. The fan can be actuated by conventional means. The cold air duct 30 preferably resides within the rear wall of the refrigerator 10, as seen in FIG. 5. The arrow 35 designates the air flow through the cold air duct 30.

Figure 6:
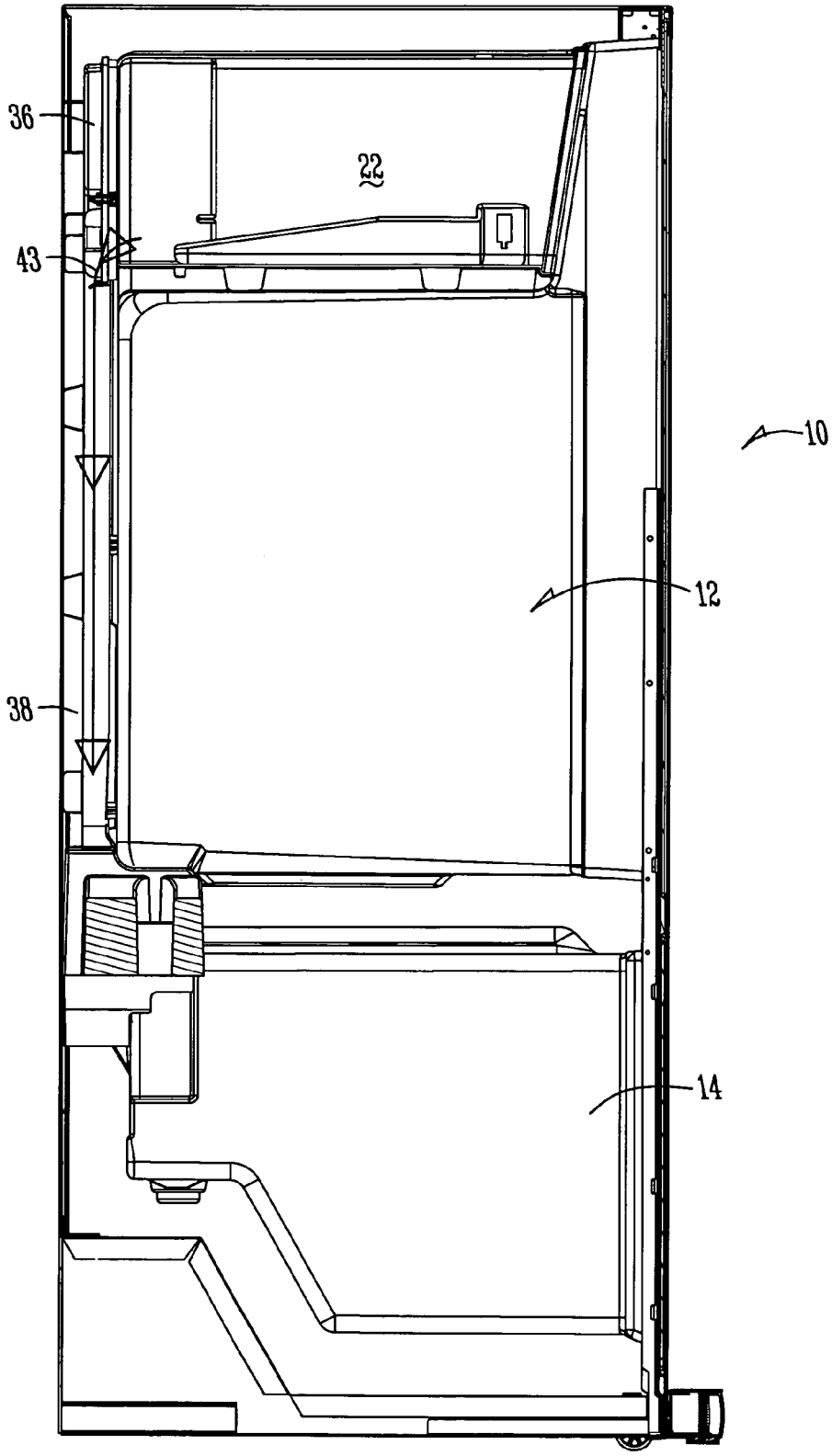
FIG. 6 is a sectional view taken along lines 6-6 of FIG. 4.

The refrigerator 10 also includes a return air duct 38 having an upper end 40 connected to the icemaker 22, and a lower end 42 terminating adjacent one of the air grates 26. Alternatively, the lower end 42 of the return air duct 38 may extend into the freezer compartment 14. Preferably, the return air duct 38 resides within the rear wall of the refrigerator 10, as seen in FIG. 6.

Figure 3:
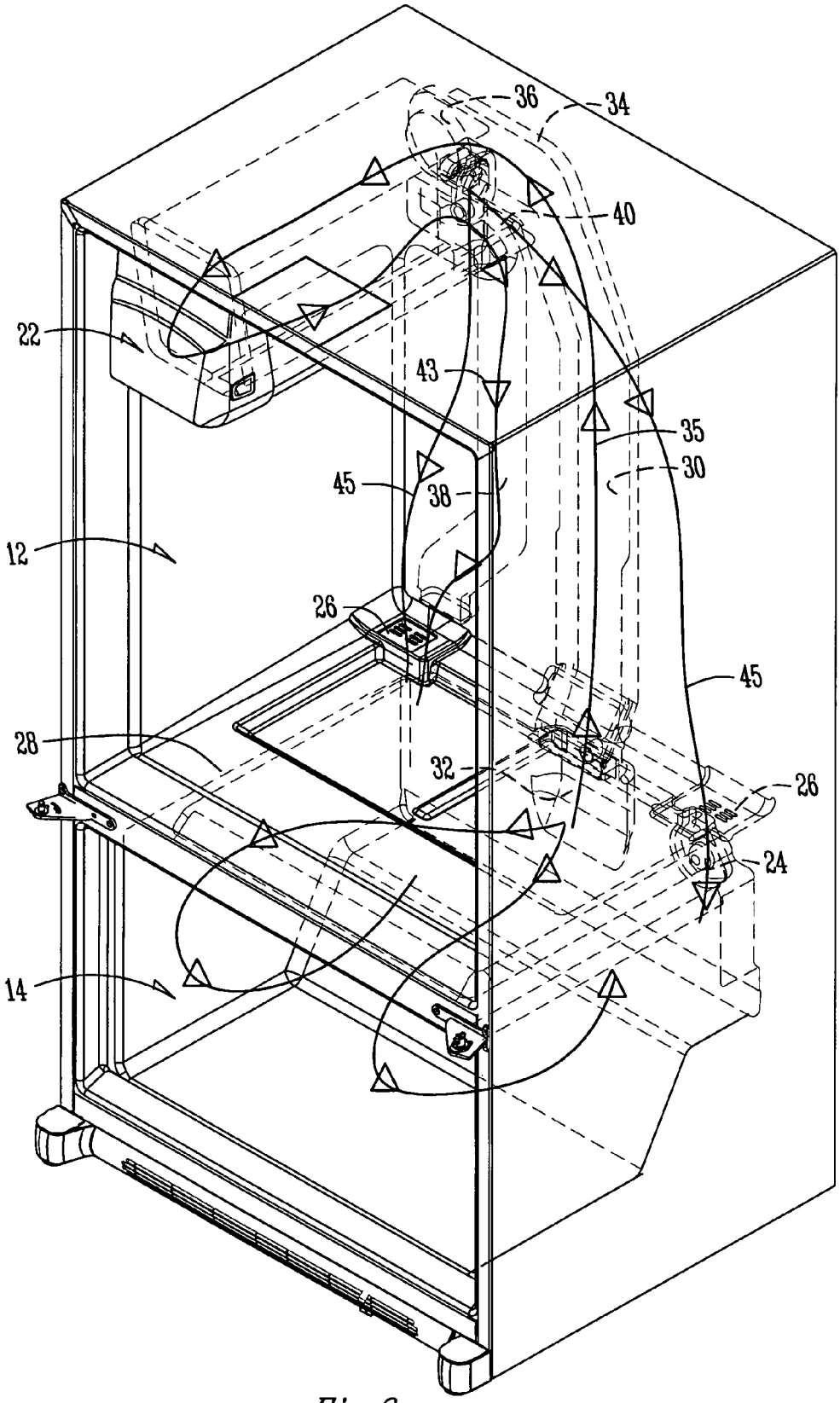
FIG. 3 is a view similar to FIG. 2 showing the cold air duct and return air duct for the icemaking compartment.

The icemaking compartment 22 also has an air vent 44 for discharging air into the refrigerator compartment 14. Thus, a portion of the air from the icemaking compartment 22 is directed through the return air duct 38 to the freezer compartment 14, as indicated by arrow 43 in FIG. 3, and another portion of the icemaking compartment air is vented through the opening 44 into the refrigerator compartment 12, as indicated by arrows 45 in FIG. 3.

Ice Compartment Damper

Figure 8:
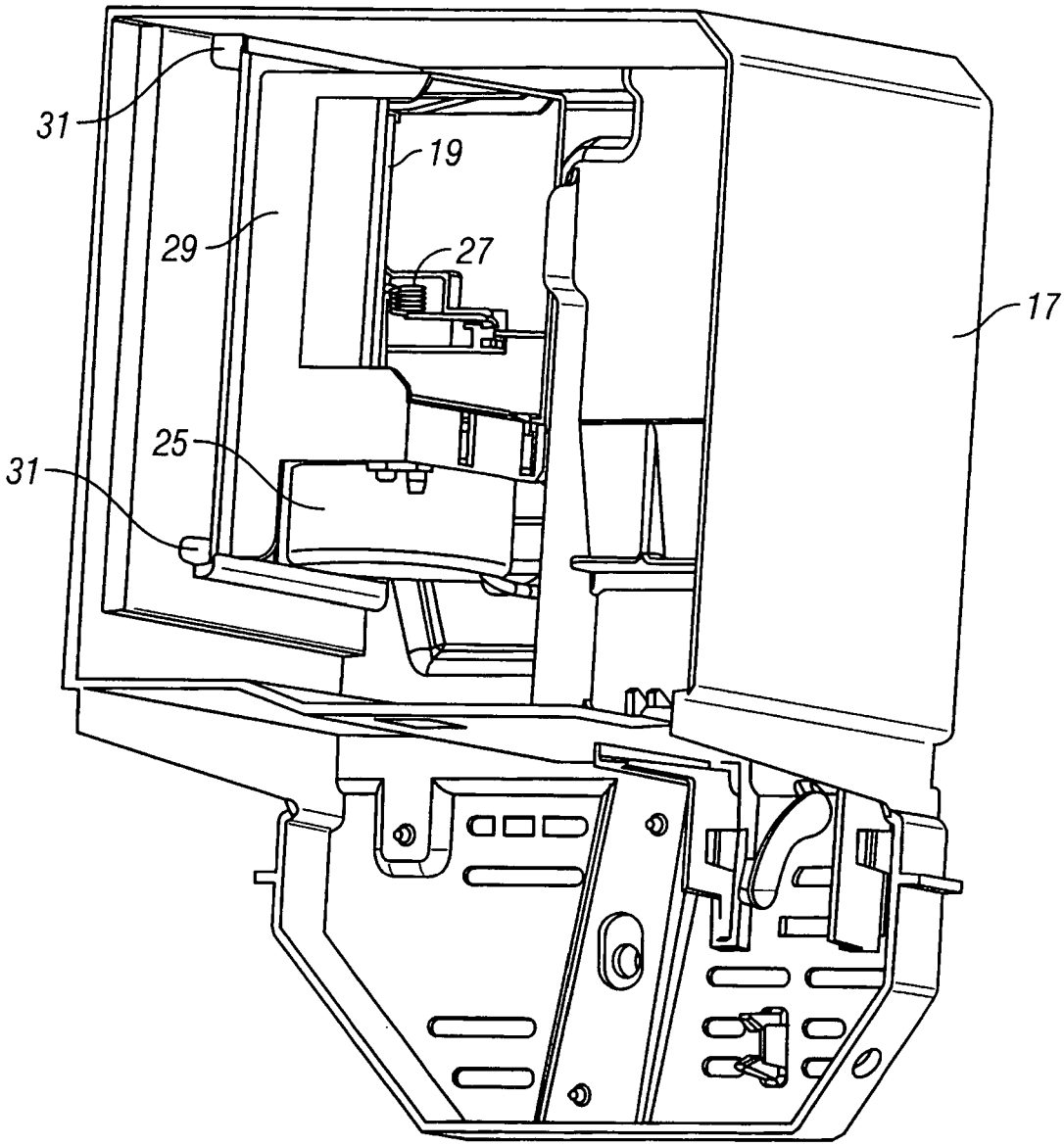
FIG. 8 is a perspective view of the ice compartment air plenum.
Figure 9:
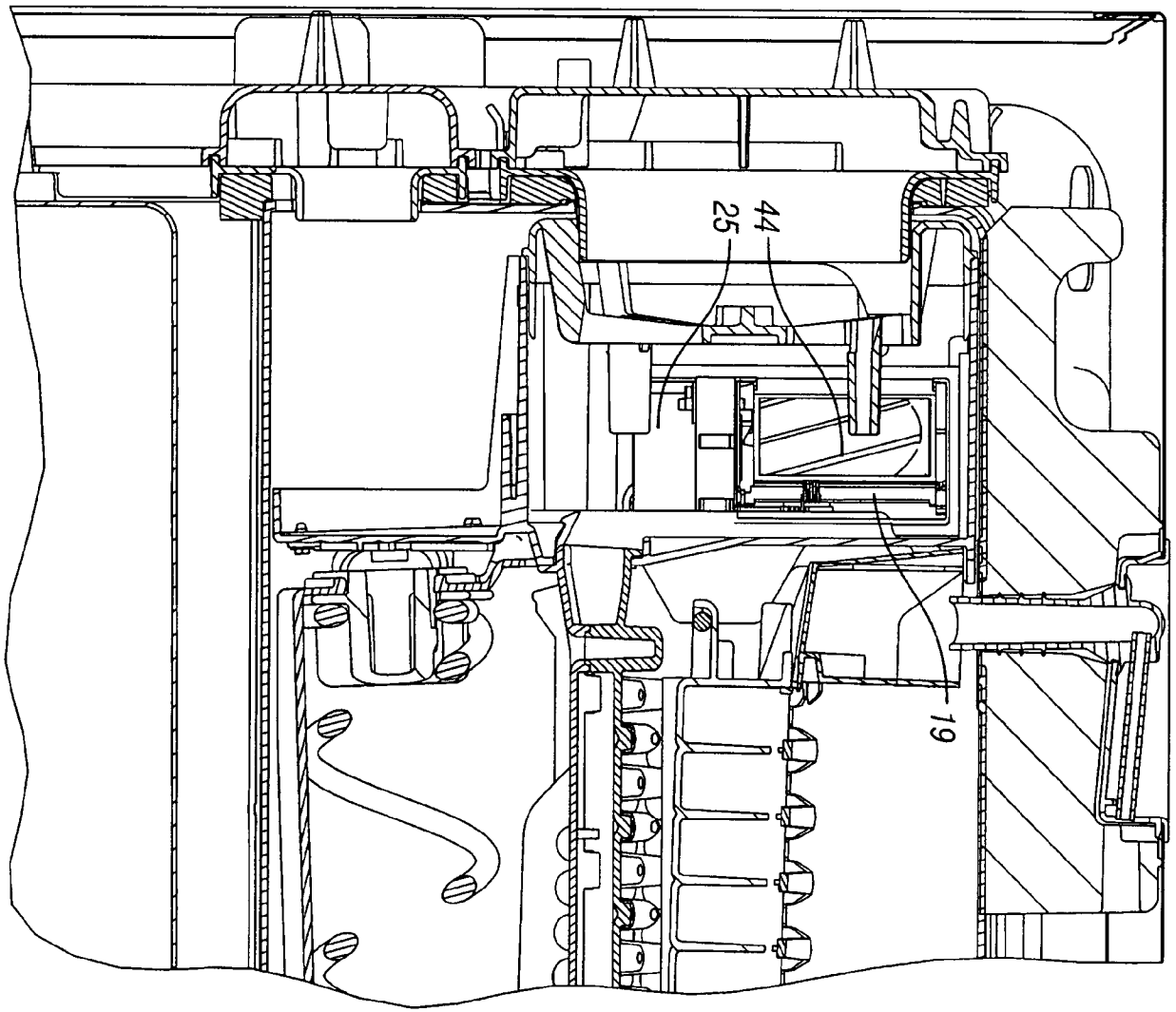
FIG. 9 is another sectional view of the plenum, with the damper in the open position.

The icemaking compartment 22 includes a rear air plenum 17 to receive air from the cold air duct 30. The vent 44 from the icemaking compartment 22 to the fresh food compartment 12 is formed in the plenum 17. A damper 19 is pivotally mounted in the plenum 17 for movement between open and closed positions, as controlled by a motor 25. A spring 27 normally biases the damper 19 to the closed position. The damper 19, motor 25, and spring 27 may be formed as an assembly and mounted on a frame 29 for easy installation in the plenum 17. More particularly, upper and lower tracks 31 are formed in the plenum 17 and receive opposite edges of the frame 29 to mount the damper, motor and spring assembly in the plenum 17, as best seen in FIG. 8.

Figure 4:
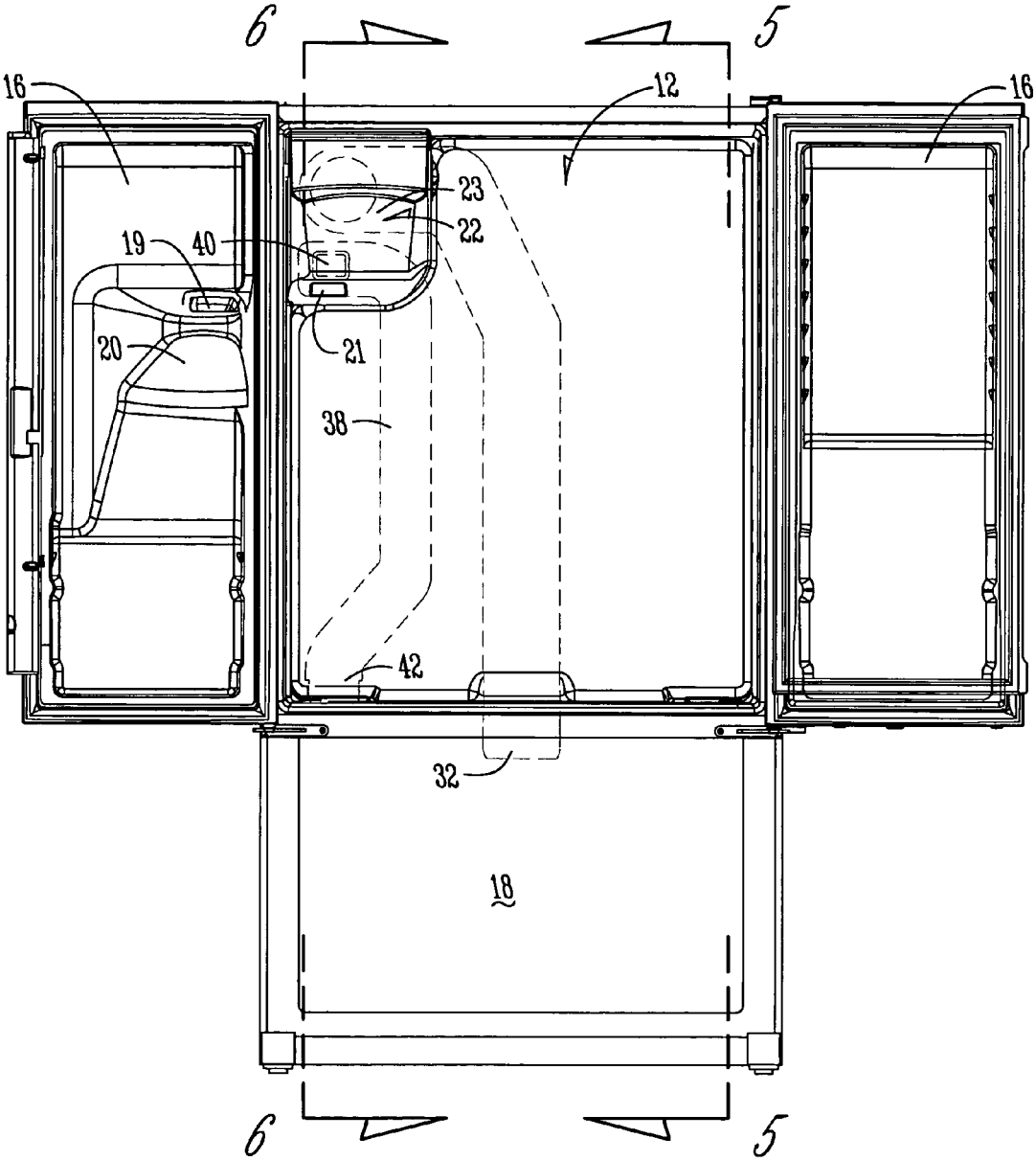
FIG. 4 is a front elevation view of the bottom mount refrigerator of the present invention with the doors open, and illustrating the cold air and return air ducts.

As seen in FIG. 4, the ice is discharged from the icemaker 22 in any conventional manner. Similarly, the ice dispenser 20 functions in a conventional manner.

Icemaker

Figure 7:
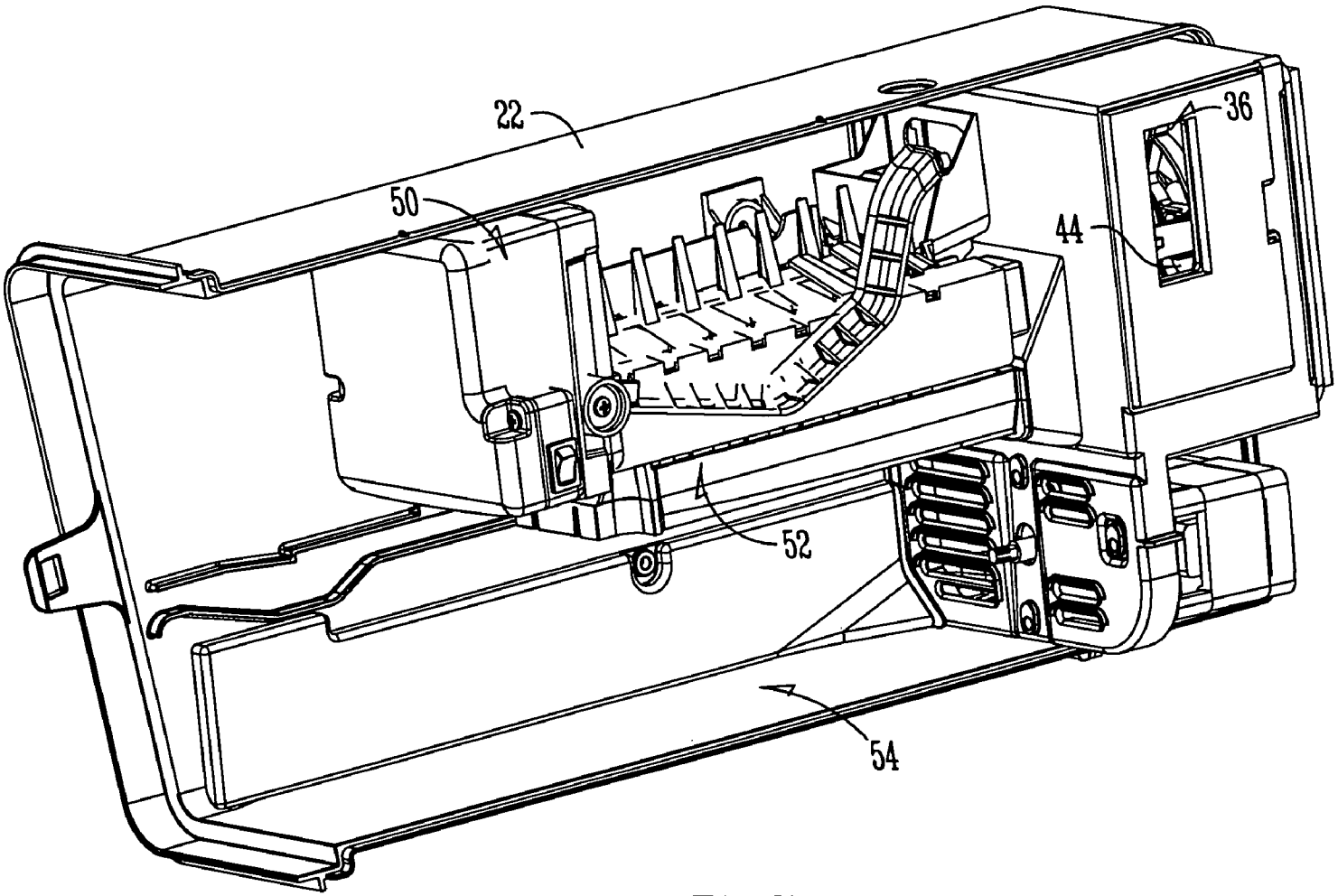
FIG. 7 is a perspective view of the icemaker positioned within the icemaking compartment.

As seen in FIG. 7, an icemaker 50 is positioned within the icemaking compartment 22 with the ice storage area 54 with auger (not shown) removed for clarity. The icemaker 50 is mounted to an impingement duct 52. The impingement duct receives freezer air coming from the freezer compartment through the cold air duct 30 and the fan assembly 36. The opening 44 vents air into the refrigerator compartment 12. The auger assembly (not shown) is provided beneath the icemaker 50 along with an ice storage bin with an insulated cover 23. Impingement on the ice maker, as well as other aspects of ice making, is disclosed in Applicant's concurrently filed U.S. application Ser. No. 11/140,100 entitled REFRIGERATOR WITH IMPROVED ICEMAKER and is hereby incorporated by reference.

Control System (Generally)

As described in more detail below, a control system is provided that utilizes the icemaking compartment 22, the cold air supply duct 30, the return air duct 38, the variable speed icemaking fan 36, icemaking impingement air duct 52, an icemaking compartment thermistor (not shown), an icemaking compartment electronic control damper, fresh food air return ducts 26, and a fresh food compartment thermistor (not shown). The above components are controlled by an algorithm that prioritizes the making of ice unless the fresh food temperature exceeds the set point temperature. This prioritization is achieved as follows:

i. When ice is a priority, the fresh food damper 19 is closed and the fan 36 runs at optimum speed. In this way, supply air from the freezer compartment 14 is discharged through the impingement air duct 52, through the ice storage area 54, and through the icemaking compartment return air duct 38. One of the results of this air flow is that ice is made at the highest rate.

ii. When the refrigerator compartment 12 is above set point, the electronic control damper 19 opens and the fan 36 runs at optimum speed. The supply air to the icemaking compartment is routed almost entirely into the fresh food compartment which forces the warmer air to return to the evaporator coil of the refrigerator. This achieves a rapid return to the fresh food set point after which the damper 19 closes and the icemaking resumes.

iii. When the ice bin is full and the fresh food temperature is satisfied, the icemaking fan 36 runs at minimum speed. Aspects of this will include: reduced energy consumption; reduced sound levels; and minimized sublimation of ice.

The above control system permits precision control of both the icemaking compartment 22 and the refrigeration compartment 12 separately, yet minimizes the complexity and the number of component parts necessary to do so.

Control System Details for Damper and Fan

Figure 10:
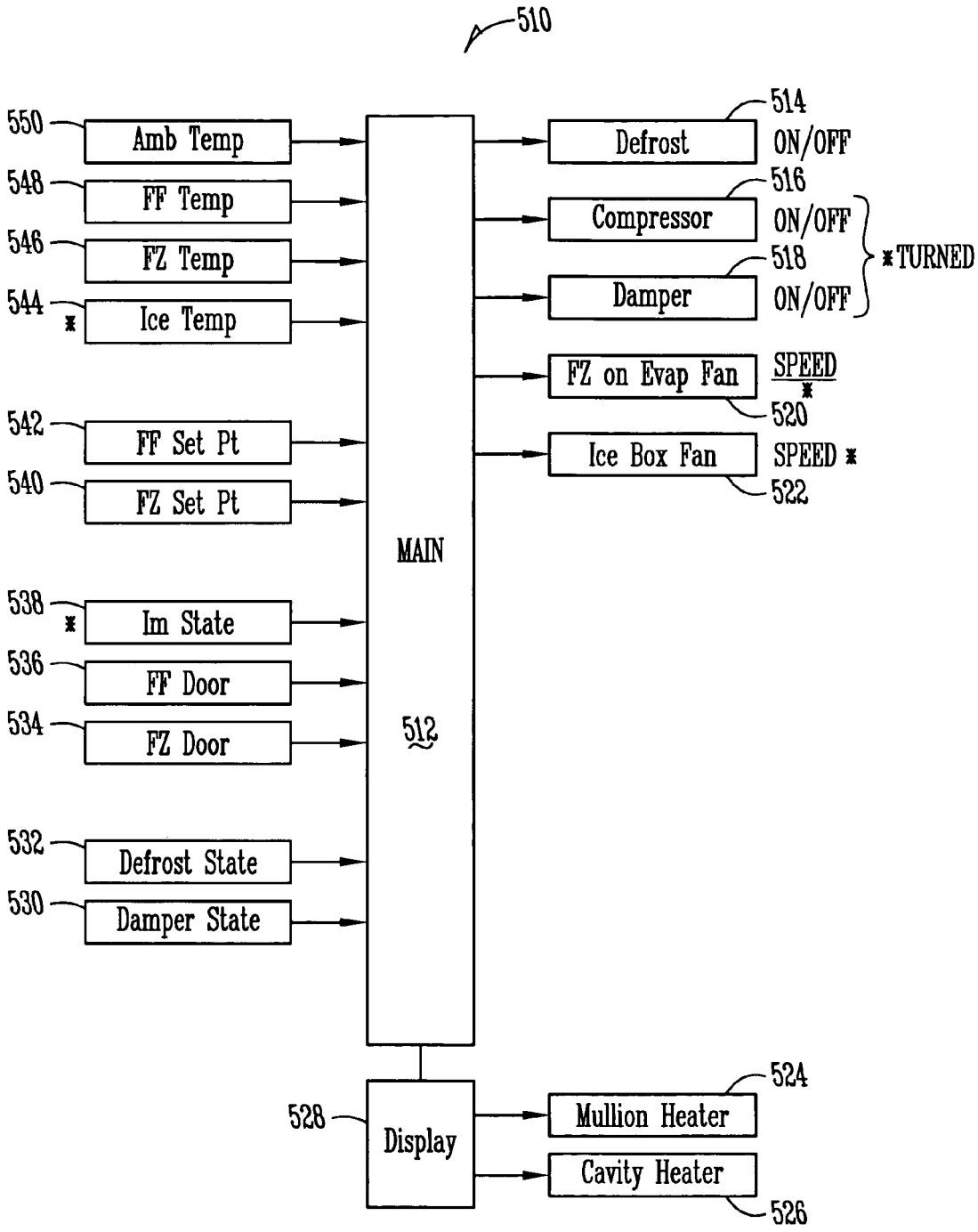
FIG. 10 is a block diagram of one embodiment of a control system according to the present invention.

FIG. 10 illustrates one embodiment of a control system of the present invention suitable for use in a refrigerator having three refrigerated compartments, namely the freezer compartment, the fresh food compartment, and the ice making compartment. The three compartments are preferably able to be set by the user to prescribed set temperatures.

In FIG. 10, a control system 510 includes an intelligent control 512 which functions as a main controller. The present invention contemplates that the control system 510 can include a plurality of networked or otherwise connected microcontrollers. The intelligent control 512 can be a microcontroller, microprocessor, or other type of intelligent control.

Inputs into the intelligent control 512 are generally shown on the left side and outputs from the intelligent control 512 are generally shown on the right side. Circuitry such as relays, transistor switches, and other interface circuitry is not shown, but would be apparent to one skilled in the art based on the requirements of the particular intelligent control used and the particular devices being interfaced with the intelligent control. The intelligent control 512 is electrically connected to a defrost heater 514 and provides for turning the defrost heater on or off. The intelligent control 512 is also electrically connected to a compressor 516 and provides for turning the compressor 516 on or off. The intelligent control 512 is also electrically connected to a damper 518 and provides for opening or closing the damper 518. The intelligent control 512 is also electrically connected to an evaporator fan 520 associated with the freezer compartment and provides for controlling the speed of the evaporator fan 520. Of course, this includes setting the evaporation fan 520 to a speed of zero which is the same as turning the evaporator fan 520 off. The use of a variable speed fan control is advantageous as in the preferred embodiment, the fan is serving an increased number of compartments with more states (freezer, fresh food, ice maker) and the ice compartment is remote from the freezer compartment.

The intelligent control 512 is electrically connected to an ice box fan 522 (element 36 in the structural drawings) and provides for controlling the speed of the ice box fan 522. Of course, this includes setting the ice box fan 522 to a speed of zero which is the same as turning the ice box fan 522 off. The intelligent control 512 also receives state information regarding a plurality of inputs. For example, the intelligent control 512 has a damper state input 530 for monitoring the state of the damper. The intelligent control 512 also has a defrost state input 532 for monitoring the state of the defrost. The intelligent control 512 also has a freezer door input 534 for monitoring whether the freezer door is open or closed. The intelligent control 512 also has a fresh food compartment door input 536 for monitoring whether the fresh food compartment door is open or closed. The intelligent control 512 also has an ice maker state input 538 for monitoring the state of the ice maker. The intelligent control 512 has a freezer set point input 540 for determining the temperature at which the freezer is set by a user. The intelligent control 512 also has a fresh food compartment set point input 542 for determining the temperature at which the fresh food compartment is set by a user. The intelligent control 512 is also electrically connected to four temperature sensors. Thus, the intelligent control 512 has an ice maker temperature input 544, a freezer compartment temperature input 546, a fresh food compartment input 548, and an ambient temperature input 550. The use of four separate temperature inputs is used to assist in providing improved control over refrigerator functions and increased energy efficiency. It is observed that the use of four temperature sensors allows the ice maker temperature, freezer compartment temperature, fresh food compartment temperature, and ambient temperature to all be independently monitored. Thus, for example, temperature of the ice box which is located remotely from the freezer can be independently monitored.

The intelligent control 510 is also electrically connected to a display control 528, such as through a network interface. The display control 528 is also electrically connected to a mullion heater 524 to turn the mullion heater 524 on and off. Usually a refrigerator has a low wattage heater to supply heat to where freezing temperatures are not desired. Typically these heaters are 120 volt AC resistive wires. Due to the fact that these heaters are merely low wattage heaters, conventionally such heaters remain always on. The present invention uses a DC mullion heater and is adapted to control the DC mullion heater to improve overall energy efficiency of the refrigerator and increase safety.

The display control 528 is also electrically connected to a cavity heater 526 for turning the cavity heater 526 on and off. The display control 528 is preferably located within the door and is also associated with water and ice dispensement. Usually a refrigerator with a dispenser with a display on the door will also have an associated heater on the door in order to keep moisture away from the electronics of the dispenser. Conventionally, this heater is continuously on.

It is to be observed that the control system 510 has a number of inputs and outputs that are not of conventional design that are used in the control of the refrigerator. In addition, the control system 510 includes algorithms for monitoring and control of various algorithms. The algorithms used, preferably provide for increased efficiency while still maintaining appropriate temperatures in the ice maker, fresh food compartment, and freezer.

Figure 11:
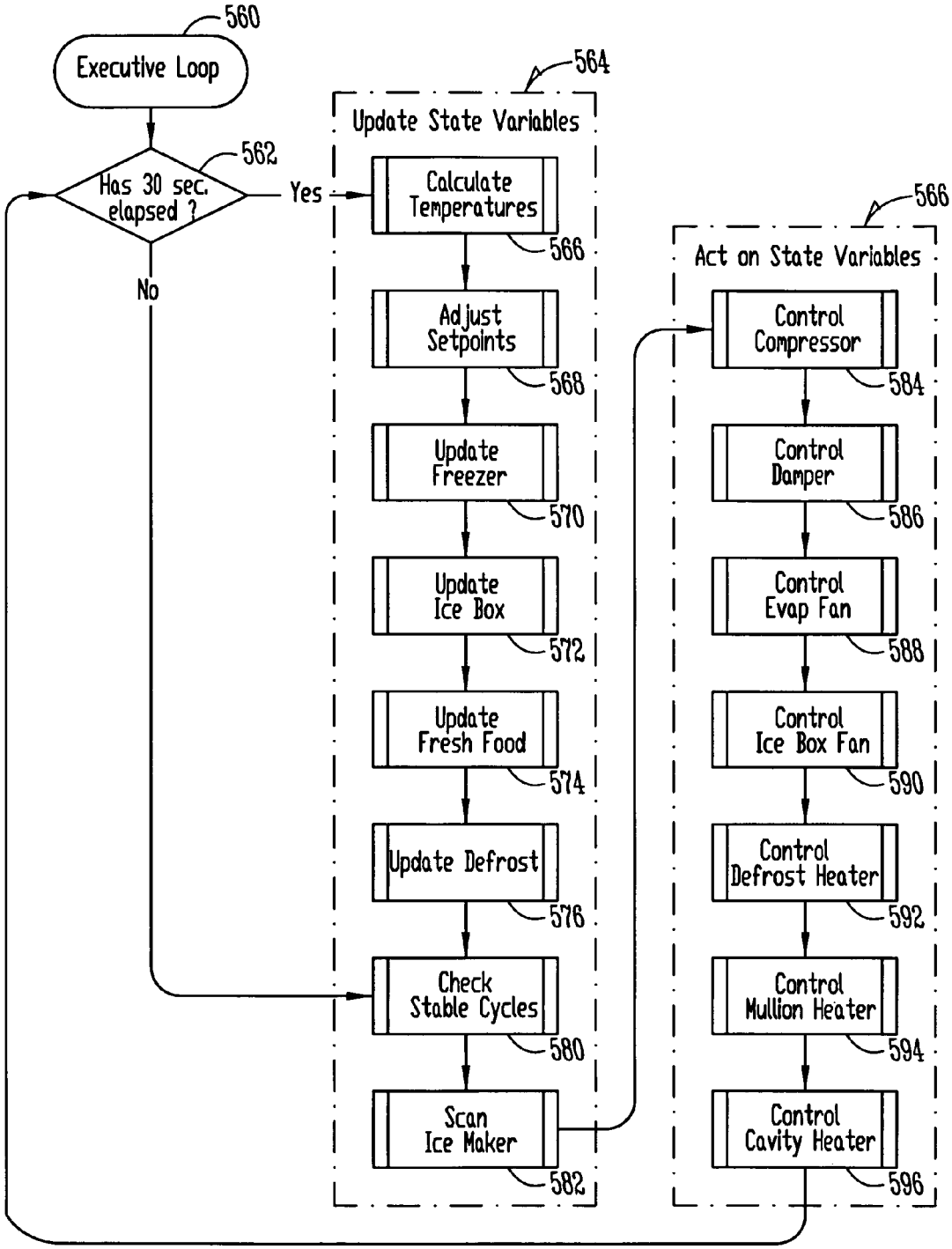
FIG. 11 is a flow diagram of an executive loop according to one embodiment of the present invention.

FIGS. 10-14 provide an exemplary embodiment of the present invention showing how the control system sets the states and controls refrigerator functions based on those states, including states associated with the fresh food compartment, freezer compartment, and ice maker compartment. FIG. 11 is a flow diagram providing an overview of one embodiment of the present invention. In FIG. 11, an executive loop 560 is shown. In step 562 a determination is made as to whether a set time period (such as 30 seconds) has elapsed. If so, then a set of steps 564 are performed to update state variables. These state variables are updated through a calculate temperatures subroutine 566, an adjust setpoints subroutine 568, an update freezer subroutine 570, an update ice box subroutine 572, an update fresh food compartment subroutine 574, an update defrost subroutine 576, a check stable cycles routine 580, and a scan ice maker subroutine 582. Once the state variables are updated, then there are a set of control subroutines 566 which act on the state variables. These control routines include a control compressor subroutine 584, a control damper subroutine 586, a control evaporator fan subroutine 588, a control ice box fan subroutine 590, and a control defrost heater subroutine 592.

As shown in FIG. 11 the status of the state variables are regularly updated in the set of steps 564. After the state variables are updated, appropriate actions are performed to control refrigerator functions.

Figure 12:
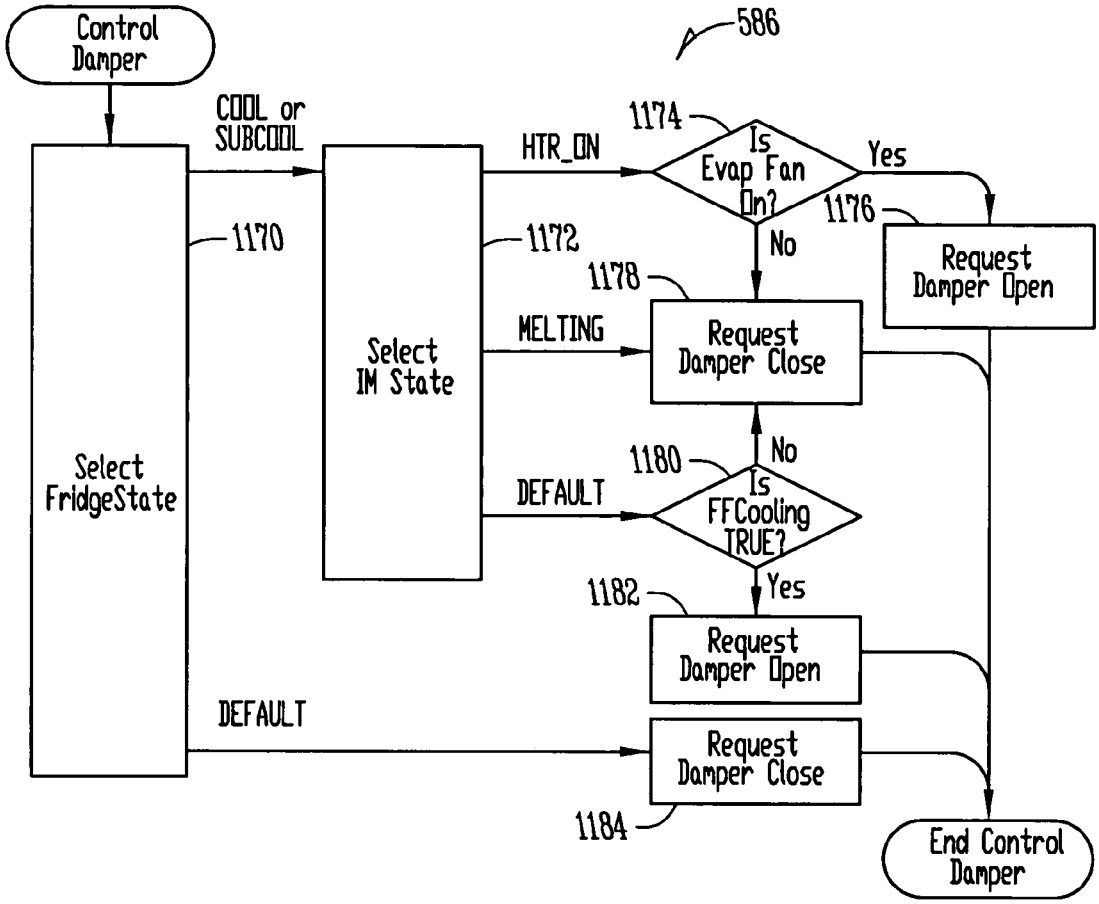
FIG. 12 illustrates one embodiment of a flow diagram for the control damper subroutine.

FIG. 12 illustrates one embodiment of a flow diagram for the control damper subroutine 586. In step 1170 the refrigerator state is selected. If the refrigerator state is COOL or SUBCOOL then in step 1172 the ice maker state is selected. IF the ice maker state is HTR_ON then in step 1174 a determination is made as to whether the evaporator fan 36 is on. If it is then in step 1174 a request is made for the damper 19 to be open. If not, then in step 1178 a request is made for the damper 19 to be closed. If in step 1172 the icemaker state is MELTING<then in step 1178 a request is made for the damper 19 to be closed. If the ice maker is in a different state (DEFAULT) then in step 1180 a determination is made as to whether the fresh food compartment is cooling. If it is not, then in step 1178 a request is made for the damper 19 to be closed. If it is, then in step 1182 a request is made for the damper 19 to be open. Returning to step 1170, if the refrigerator is in a DEFAULT state, then in step 1184 a request is made to close the damper 19.

Figure 13:
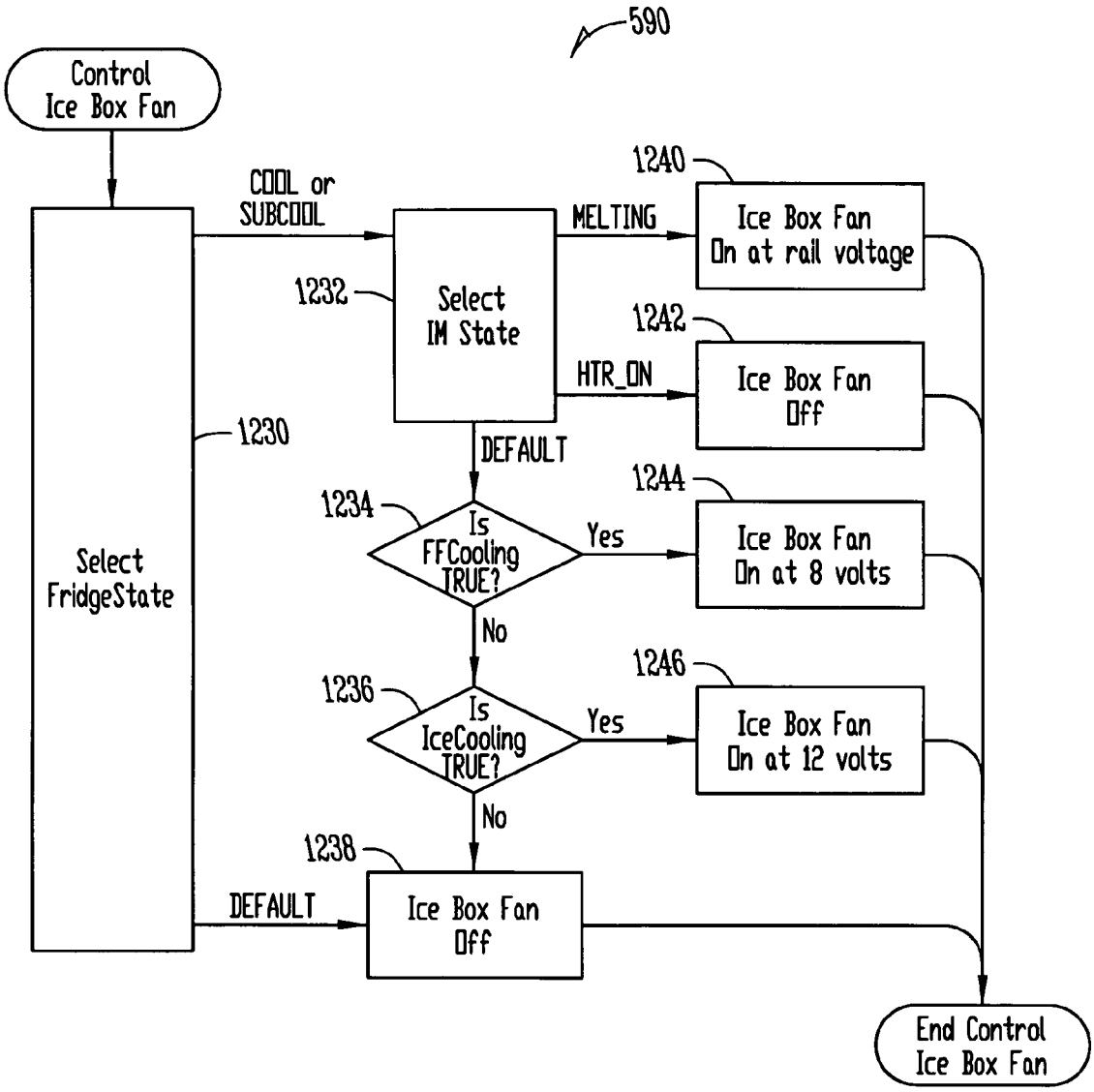
FIG. 13 illustrates one embodiment of a flow diagram for the control ice box fan subroutine.

FIG. 13 illustrates one embodiment of a flow diagram for the control ice box fan subroutine 590. In step 1230, a refrigerator state (FridgeState) is determined. If the refrigerator state is COOL or SUBCOOL, then in step 1232, the ice maker state is selected. If the ice maker state is MELTING, then the ice box fan 36 is turned full-on in step 1240 such as by applying the rail voltages to the ice box fan 36. If the ice maker state indicates that the heater is on (HTR_ON), then the ice box fan 36 is turned of in step 1242. If the ice maker state is in a different or DEFAULT state, then in step 1234 a determination is made as to whether the fresh food compartment is in a cooling (FFCooling) state. If it is, then in step 1244 the ice box fan 36 is turned at less than full voltage to conserve energy. If not, then in step 1236 a determination is made as to whether the ice compartment is in a cooling (IceCooling) state. If it is in then in step 1246, the icebox fan Is turned on at a higher voltage than in step 1244. In step 1238, if neither the fresh food compartment is cooling nor the ice maker compartment is cooling, the ice box fan 36 is turned off. Thus the ice box fan 36 is controlled in an energy efficient manner.

Miscellaneous

Applicant's co-pending provisional application, Ser. No. 60/613,241 filed Sep. 27, 2004, entitled APPARATUS AND METHOD FOR DISPENSING ICE FROM A BOTTOM MOUNT REFRIGERATOR, is hereby incorporated by reference in its entirety. This application and the provisional application both relate to a refrigerator with a bottom mount freezer and an icemaking compartment for making ice at a location remote from the freezer. However, it is understood that the plenum, damper, vent, fan and control system of this invention can also be used on a top mount or side-by-side refrigerator.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved refrigerator, comprising:

a fresh food compartment;

a freezer compartment;

an ice making compartment with an ice maker therein and an ice storage bin;

an air duct for supplying air from the freezer compartment to the ice making compartment;

a damper in the ice compartment movable between open and closed positions;

wherein a portion of the air from the ice making compartment is released to the fresh food compartment when the damper is open;

a variable speed fan for moving the air from the freezer compartment to the ice making compartment; and the fan operating at maximum speed when the bin is less than full or ice, and the fan operating at a reduced speed when the bin is full of ice.

2. The improved refrigerator of claim 1 further comprising a control system for moving the damper between the open and closed positions.

3. The improved refrigerator of claim 1 wherein the damper is normally closed.

4. The improved refrigerator of claim 1 wherein the damper is opened when the temperature of the fresh food compartment is above a pre-determined set point.

5. The improved refrigerator of claim 1 wherein at least 10% of the air is maintained in the ice compartment when the damper is open.

6. The improved refrigerator of claim 1 wherein the fan operates at maximum speed when the damper is open.

7. The improved refrigerator of claim 1 wherein the ice compartment includes a plenum, with the fan and damper being mounted in the plenum.

8. The improved refrigerator of claim 7 wherein the plenum includes an air vent leading to the fresh food compartment and over which the damper is mounted.

9. The improved refrigerator of claim 1 wherein the freezer compartment is below the fresh food compartment.

10. A method of regulating air flow within a refrigerator having a fresh food compartment, a freezer compartment, an ice making compartment with a variable speed fan and an ice storage bin, and a duct for supplying air from the freezer compartment to the ice making compartment, the method comprising:

moving a damper in the ice compartment between open and closed positions in response to the temperature of the fresh food compartment;

directing air from the ice making compartment to the fresh food compartment when the damper is open;

regulating the fan speed; and maximizing the fan speed when the storage bin is less than full of ice.

11. The method of claim 10 wherein the damper is normally closed.

12. The method of claim 10 wherein the damper is opened when the temperature in the fresh food compartment exceeds a pre-determined set point.

13. The method of claim 10 further comprising retaining at least 10% of the air in the ice compartment when the damper is opened.

14. The method of claim 10 further comprising the fan speed when the damper is open.

15. The method of claim 10 further comprising reducing the fan speed when the storage bin is full of ice.

16. The method of claim 10 further comprising locating the ice making compartment remote from the freezer compartment.

17. A method of regulating air flow within a refrigerator having a fresh food compartment, a freezer compartment, an ice making compartment with a variable speed fan and an ice storage bin, and a duct for supplying air from the freezer compartment to the ice making compartment, the method comprising:

moving a damper in the ice compartment between open and closed positions in response to the temperature of the fresh food compartment;

directing air from the ice making compartment to the fresh food compartment when the damper is open;

with a variable speed fan and an ice storage bin;

regulating the fan speed; and reducing the fan speed when the storage bin is full of ice.

18. The method of claim 17 further comprising maximizing the fan speed when the storage bin is less than full of ice.

19. The method of claim 17 wherein the damper is normally closed, and is opened when the temperature in the fresh food compartment exceeds a pre-determined set point.

* * * * *